US011253009B1

(12) United States Patent
Armendariz

(10) Patent No.: US 11,253,009 B1
(45) Date of Patent: Feb. 22, 2022

(54) SUN PROTECTING COVER

(71) Applicant: Cesar Armendariz, Boca Raton, FL (US)

(72) Inventor: Cesar Armendariz, Boca Raton, FL (US)

( * ) Notice: Subject to any disclaimer, the term of this patent is extended or adjusted under 35 U.S.C. 154(b) by 221 days.

(21) Appl. No.: 16/597,954

(22) Filed: Oct. 10, 2019

(51) Int. Cl.
*A41D 1/00* (2018.01)
*A41D 27/16* (2006.01)
*A41D 27/18* (2006.01)

(52) U.S. Cl.
CPC ..... *A41D 1/00* (2013.01); *A41D 27/16* (2013.01); *A41D 27/18* (2013.01); *A41D 2300/33* (2013.01); *A41D 2400/26* (2013.01)

(58) Field of Classification Search
CPC .... A41D 27/18; A41D 27/16; A41D 2400/26; A41D 2300/33
See application file for complete search history.

(56) References Cited

U.S. PATENT DOCUMENTS 1,285,917 A * 11/1918 Smith ..... A41D 1/04 2/91
2,150,069 A * 3/1939 Koleno ..... A41D 13/08 2/59
2,237,368 A * 4/1941 Seitzman ..... A41D 15/00 2/91
2,523,636 A * 9/1950 Sherman ..... A41D 10/00 2/114
3,618,139 A * 11/1971 Hugin ..... A41B 1/00 2/115
4,516,273 A * 5/1985 Gregory ..... A63B 71/12 2/462
4,570,267 A * 2/1986 Appel ..... A41B 9/06 2/91
4,706,304 A * 11/1987 Jones ..... A41D 1/04 2/91
5,033,118 A * 7/1991 Lincoln ..... A41D 27/28 2/115
5,088,116 A * 2/1992 Gould ..... A41D 3/06 2/115
5,375,261 A * 12/1994 Lipke ..... A41D 13/0051 2/103
5,720,044 A * 2/1998 Robinson ..... A41B 1/00 2/115
5,902,261 A * 5/1999 Schwartz ..... A61F 5/3746 602/61

(Continued)

*Primary Examiner* — Khaled Annis
(74) *Attorney, Agent, or Firm* — Sanchelima & Associates, P.A.; Christian Sanchelima; Jesus Sanchelima

(57) ABSTRACT

A sun protecting cover system including a body cover assembly and an attachment assembly is disclosed herein. The sun protecting cover protects users from the sun and the ultra violet rays that the sun emits. The sun protecting cover substantially covers and protects the shoulders and neck of a user. The user can enjoy the outdoors while minimizing their exposure to the sun with the sun protecting cover. The sun protecting cover has an ultraviolet protection factor from 15 to 50 plus in order to sufficiently protect a user from the ultra violet rays of the sun. The sun and its ultra violet rays are damaging to users' skin as too much sun exposure may lead to sunburns or health concern such as skin cancer. The sun protecting cover is secured to the body of a user with the pair of elastic bands that are included in the attachment assembly.

10 Claims, 2 Drawing Sheets

(56) References Cited

U.S. PATENT DOCUMENTS

| | | | | |
|---|---|---|---|---|
| 7,343,629 | B2 * | 3/2008 | Hunt | A41D 1/22 2/93 |
| D603,139 | S * | 11/2009 | Martin | D2/823 |
| D639,024 | S * | 6/2011 | Benderradji | D2/830 |
| 8,826,465 | B2 * | 9/2014 | Greenblat | A41D 1/22 2/69 |
| 9,055,775 | B2 * | 6/2015 | Taul | A41D 23/00 |
| 10,299,522 | B2 * | 5/2019 | Kuo | A41D 13/1263 |
| 2008/0047044 | A1 * | 2/2008 | Jones | A41D 27/10 2/84 |
| 2008/0301862 | A1 * | 12/2008 | Montgomery | A41D 13/05 2/463 |
| 2009/0013445 | A1 * | 1/2009 | Martin | A41D 1/04 2/93 |
| 2012/0079644 | A1 * | 4/2012 | Benderradji | A41D 23/00 2/207 |
| 2016/0044979 | A1 | 2/2016 | Norman | |
| 2016/0050994 | A1 * | 2/2016 | Bushby | A41B 9/06 2/243.1 |
| 2017/0280790 | A1 * | 10/2017 | Verma | A41F 1/02 |
| 2018/0055111 | A1 * | 3/2018 | Chia | A41D 27/085 |
| 2018/0103703 | A1 * | 4/2018 | Rinne | A41D 13/0012 |
| 2019/0313715 | A1 * | 10/2019 | Douglas | A41D 13/05 |
| 2020/0138125 | A1 * | 5/2020 | Beaudry | A41D 31/245 |

* cited by examiner

SUN PROTECTING COVER

BACKGROUND OF THE INVENTION

1. Field of the Invention

The present invention relates to a sun protecting cover system and, more particularly, to a sun protecting cover system that protects a wearer's shoulders and neck from ultra violet rays that cause sun damage and sunburns.

2. Description of the Related Art

Several designs for sun protecting covers have been designed in the past. None of them, however, include a shoulder cover or cape, which is used to protect the wearer from the sun, comprising a bat wing shaped garment having a pair of elastomeric armpit bands or straps for securing the device to the wearer. The sun emits ultra violet rays that are extremely damaging. There is a need to protect a person's skin from the sun as to avoid health issues such as skin cancer. Excessive sun exposure can additionally damage the skin of a person. It may not be sufficient enough for a user to only use a sunscreen lotion. Further, the sunscreen lotion loses effectiveness over time as sweat and water can wash the sunscreen lotion off of the skin of a user. Other users may find wearing sunscreen lotion to be uncomfortable as they may not like the way the sunscreen lotion feels on their skin. Hence there is a need for a cover, like that of the present invention, that protects the neck and shoulders of a person. The cover being easily deployed and removed when there is a need for protection from the sun and its ultra violet rays.

Applicant believes that a related reference corresponds to U.S. patent No. 2016/0044979 A1 issued to Zachary Norman et al. for Sun Shield Garment. However, it differs from the present invention because the Norman et al. reference is restricting and suffocating for comfortable use outdoors. The present invention is quickly attached to a user by means of a pair of elastomeric bands. Additionally, the present invention is more comfortable than the Norman et al. reference as it only covers the shoulders and a substantial portion of the neck of a user. This differs from the Norman et al. reference which substantially covers the head of a person in addition to the both arms of a person entirely. The present invention protects a user from the sun and the sun rays while not making a user more uncomfortable under the sun.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a sun protecting cover that shields a user from the ultra violet rays of the sun that result in sun damage and sunburns.

It is another object of this invention to provide a sun protecting cover that is easily operated meaning it is easily attached to a person, removed from a person or stored.

It is still another object of the present invention to provide a sun protecting cover that comfortably covers and protects a user's shoulders and neck.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
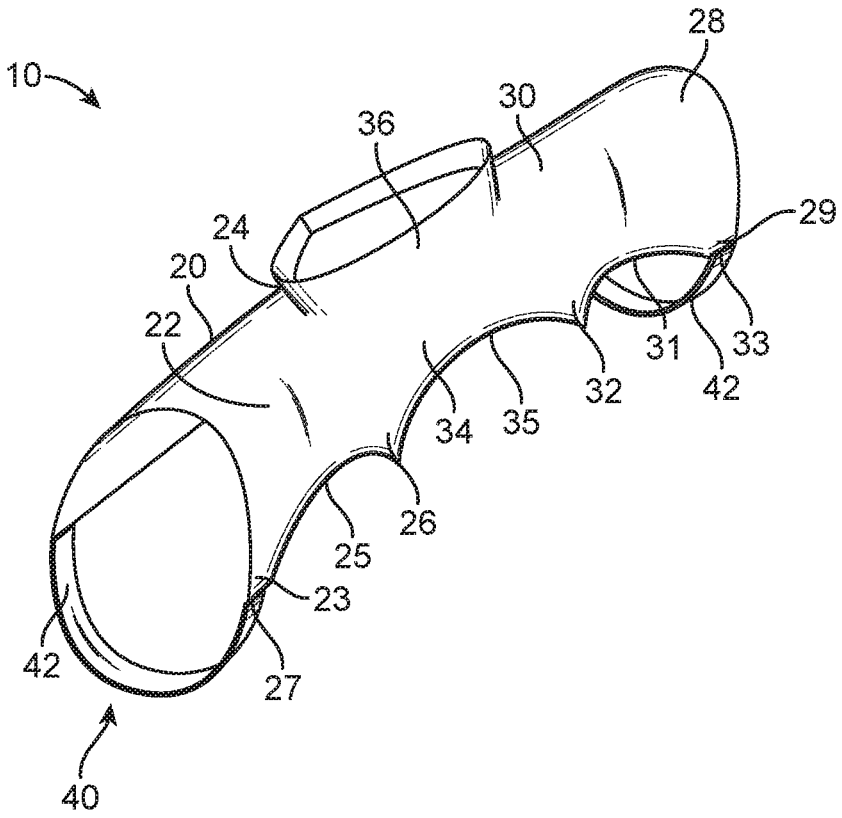
FIG. 1 represents an isometric view of the present invention.

Referring now to the drawings, where the present invention is generally referred to with numeral 10, it can be observed that it basically includes a body cover assembly 20 and an attachment assembly 40.

Figure 2:
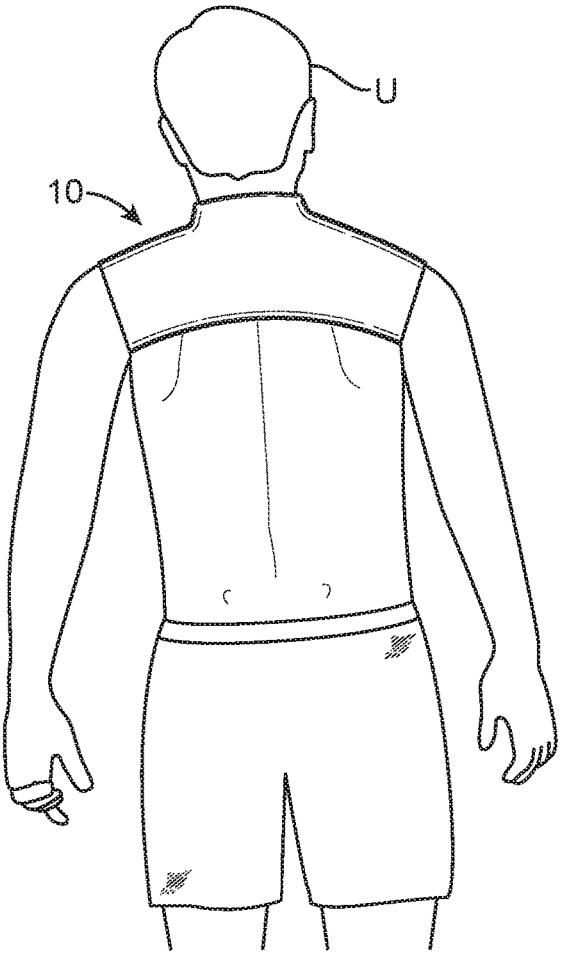
FIG. 2 illustrates a front view of a user wearing the present invention.
Figure 3:
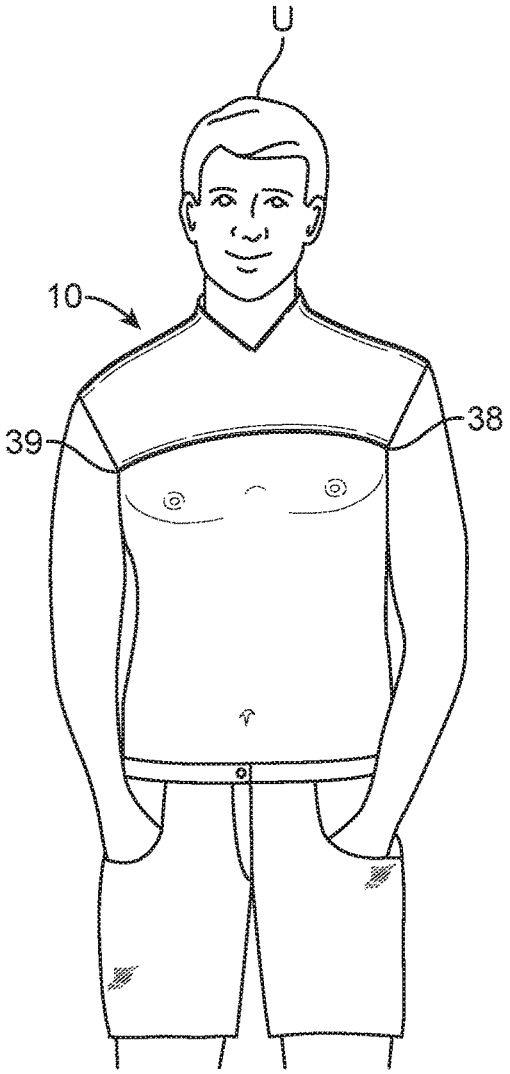
FIG. 3 illustrates a back view of a user wearing the present invention.

Referring to FIG. 1 through 3 it can be seen that a sun protecting cover 10 to protect a user from the sun and the ultra violet rays that the sun emits is depicted. Sun protecting cover 10 includes body cover assembly 20. Body cover assembly 20 further includes a left side 22, a right side 28, a center portion 34 and a neck portion 36. Left side 22 connects to right side 28 through center portion 34. Center portion 34 can be seen in-between left side 22 and right side 28. Left side 22 entirely covers the left shoulder or deltoid of a user U while right side 28 entirely covers the right shoulder or deltoid of user U. Center portion 34 substantially covers the upper back and trapezius muscles of user U. Neck portion 36 extends upwardly from center portion 34 and substantially covers the neck of user U. Neck portion 36 is preferably rectangular shaped at a back side, yet curving and triangular shaped or V-shaped at a front side, however any other shapes may be suitable. Neck portion 36 provides more coverage at the back side thereof than at the front side to the neck of user U. Sun protecting cover 10 is preferably bat shaped, however it should be understood that virtually any other shape that covers the aforementioned parts of user U may also be suitable. Hence, it can be seen that sun protecting cover 10 results in the shoulders, upper back, trapezius and neck of user U being protected from sunburns or other health concerns such as skin cancer.

Referring to FIG. 1, it can be seen that each of left side 22, right side 28 and center portion 34 can be further defined by additional parts or components of sun protecting cover 10. Left side 22 further includes a left side distal end 23 which extends below the left shoulder of user U. Left side 22 additionally includes a left side proximal end 24 which extends to the neck of user U and is also adjacent to center portion 34. Similarly, right side 28 further includes a right side distal end 29 which extends below the right shoulder of user U. Right side 28 additionally includes a right side proximal end 30 which extends to the neck of user U and is also adjacent to center portion 34. Preferably, left side distal end 23 and right side distal end 29 slope downwardly. On the lower left peripheral side of center portion 34 it can be seen that sun protecting cover 10 has a left side shoulder blade extension 26. While on the lower right peripheral side of center portion 34 it can be seen that sun protecting cover 10 has a right side shoulder blade extension 32. A left side cavity 25 is defined between left side distal end 23 and left side shoulder blade extension 26. Left side cavity 25 may be concave. A right side cavity 31 is defined between right side distal end 29 and right side shoulder blade extension 32. Like left side cavity 25, right side cavity 31 may be concave. Alternatively, left side cavity 25 and right side cavity 31 may be convex. Center portion 34 may also include a cavity similar to those of the aforementioned cavities. A center portion cavity 35 may be defined as extending between left side shoulder blade extension 26 and right side shoulder blade extension 32. Center portion cavity 35 may preferably be concave, but in an alternate embodiment may be convex. On each of the shoulder blade extensions, there may be a mounting member. Each mounting member is further defined as a left side mounting member 27 and a right side mounting member 33. On the front of sun protecting cover 10 there may be a corresponding anchoring member, a left side anchoring member 38 and right side anchoring member 39. Attachment assembly is mounted between left side mounting member 27 and left said anchoring member 39 on left side 22 and between right side mounting member 33 and right side anchoring member 39 on right side 28. It should be understood that left side shoulder blade extension 26 and right side shoulder blade extension 32 define peaks which separate left side cavity 25, right side cavity 31 and center portion cavity 35. More specifically, left side shoulder blade extension 26 separates left side cavity 25 from center portion cavity 35. While right side shoulder blade extension 32 separates right side cavity 31 from center portion cavity 35. There are arches extending therebetween each of the peaks. Each arch defines one of left side cavity 25, right side cavity 31 and center portion cavity 35.

Referring to FIG. 2 and FIG. 3, it can be seen how user U may wear the sun protecting cover 10. Importantly, it can be seen that sun protecting cover 10 does not extend beyond the lower end of the shoulder blade of user U. Thereby, neither left side distal end 23, left side shoulder blade extension 26, right side distal end 29 nor right side shoulder blade extension 32 do not extend beyond the lower end of the shoulder blades of user U. Attachment assembly 40 can be best seen in FIG. 2 and FIG. 3. Attachment assembly 40 includes two elastic straps 42. Each of two elastic straps 42 attaches to a mounting member on one side of sun protecting cover 10 and to an anchoring member on another side of sun protecting cover 10. On left side 22 of sun protecting cover 10, one end of one of two elastic straps 42 attaches to left side mounting member 27 and another end of one of two elastic straps 42 attaches to left side anchoring member 38. Similarly, on right side 28 of sun protecting cover 10, one end of one of two elastic straps 42 attaches to right side mounting member 33 and another end of one of two elastic straps 42 attaches to right side anchoring member 39. Thereby allowing each of two elastic straps 42 to be able to receive an arm of user U therethrough until each of two elastic straps 42 engages the left and right armpit of user U. When each of two elastic straps 42 are underneath of the armpits of user U then the present invention is secured to user U. Sun protecting cover 10 is entirely flush and in direct contact with the body of user U when worn, appearing like a cape on user U. Each of two elastic straps 42 may be flush with the peripheral edges of sun protecting cover 10. Meaning two elastic straps 42 extend only as far as left side 22 and right side 28 do.

Preferably, sun protecting cover 10 is lightweight and breathable. The light weight nature of sun protecting cover 10 allows a person to remain comfortable while wearing the present invention, but still being protected from the sun and its ultra violet lights. Sun protecting cover 10 may be made of cloth, but other fabrics in the art of wearable clothing may be suitable. Preferably the material of sun protecting cover 10 has an ultraviolet protection factor from 15 to 50 plus. With such ultraviolet protection factor a person can be safe from sunburns and minimize health concerns such as skin cancer. Attachment assembly 40 makes it possible to easily attach and detach sun protecting cover 10 to user U. User U can easily and quickly store sun protecting cover 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sun protecting cover system, comprising:

a body cover assembly;

an attachment assembly mounted to said body cover assembly;

said body cover assembly having a left side, a center portion, a neck portion, and a right side;

said left side having a dimension that is configured to entirely cover a user's left middle trapezius, said right side having a dimension that is configured to entirely cover a user's right middle trapezius, said left side having a left side distal end configured to extend below a user's left shoulder, said left side distal end is located in a left edge of a rear left side, a left side proximal end adjacent said center portion configured to be extended to a user's neck, said neck portion is configured to substantially cover a user's neck and center middle trapezius, said neck portion extends upwards from said center portion, a front portion of said neck portion has a triangular shape, said right side being connected to said left side using said center portion, a left side cavity located in said rear left side being concave and defined between said left side distal end and a left side shoulder blade extension, said left side shoulder blade extension is located in said rear left side, said left side shoulder extension has a pointed shape, said left side distal end includes a left side mounting member, said mounting member is located in said rear left side proximal to said left side distal end, a center cavity extending from said left side shoulder blade extension to a right side shoulder blade extension, said center cavity is located in a rear center portion, said right shoulder blade extension is located in a rear right side, said right shoulder blade extension has a pointed shape, said center cavity being concave, said neck portion providing more coverage at a neck back side than a neck front side, said right side includes a right side proximal end adjacent said center portion that is configured to extend to a user's neck, said right side includes a right side distal end, said right side distal end is located in a right edge of a rear right side, said right side distal end is configured to extend down a user's arm below a right shoulder, said right side distal end and said left side distal end slope downwards, a right side cavity defined between said right side shoulder blade extension and said right side distal end, said right side cavity is located in said rear right side, said right side distal end includes a right side mounting member, said right side mounting member is located in said rear right side proximal to said right side distal end;

said attachment assembly includes two elastic straps that are mounted to said body cover assembly using said right side mounting member and said left side mounting member, said two elastic straps are configured to engage a user's right and left armpit, respectively, from a rear side of said body cover assembly to a front side of said body cover assembly, said two elastic straps are attached to a right side anchoring member and to a left side anchoring member, said right side anchoring member is located in a right edge of a right front side of said body cover assembly, said left side anchoring member is located in a left edge of a left front side of said body cover assembly, thereby said two elastic straps are configured to secure said sun protecting cover to a user's body, said body cover assembly is configured to shield a left shoulder of a user, a right shoulder of a user, a left shoulder blade of a user, a right shoulder blade of a user, a neck of a user, middle trapezius of a user and an upper portion of a back of a user from UV rays, said body cover assembly is configured to be entirely flush and in direct contact with a user's body, said left side is configured not to extend over a left acromion bone of a user, said right side is configured not to extend over a right acromion bone of a user, said sun protecting cover has an ultraviolet protection factor from 15 to 50 plus.

2. The sun protecting cover system of claim 1, wherein said garment cover is made of cloth.

3. The sun protecting cover system of claim 1, wherein a rear side of said sun protecting cover is bat wing shaped.

4. The sun protecting cover system of claim 1, wherein said neck portion is curved at a back side.

5. The sun protecting cover system of claim 1, wherein said neck portion is V-shaped shaped at a front side.

6. The sun protecting cover system of claim 1, wherein said left side shoulder blade extension and said right side shoulder blade extension define peaks which separate said left side cavity, said right side cavity and said center portion cavity.

7. The sun protecting cover system of claim 6, wherein said left side shoulder blade extension separates said left side cavity from said center portion cavity, while said right side shoulder blade extension separates said right side cavity from said center portion cavity.

8. The sun protecting cover system of claim 1, wherein said two elastic straps are flush with peripheral edges of said sun protecting cover.

9. A sun protecting cover system, comprising:

a body cover assembly;

an attachment assembly mounted to said body cover assembly;

said body cover assembly having a left side, a center portion, a neck portion, and a right side;

said left side having a dimension that is configured to entirely cover a user's left middle trapezius, said right side having a dimension that is configured to entirely cover a user's right middle trapezius, said left side having a left side distal end configured to extend below a user's left shoulder, said left side distal end is located in a left edge of a rear left side, a left side proximal end adjacent said center portion configured to be extended to a user's neck, said neck portion is configured to substantially cover a user's neck and center middle trapezius, said neck portion extends upwards from said center portion, a front portion of said neck portion has a triangular shape, said right side being connected to said left side using said center portion, a left side cavity located in said rear left side being concave and defined between said left side distal end and a left side shoulder blade extension, said left side shoulder blade extension is located in said rear left side, said left side shoulder extension has a pointed shape, said left side distal end includes a left side mounting member, said mounting member is located in said rear left side proximal to said left side distal end, a center cavity extending from said left side shoulder blade extension to a right side shoulder blade extension, said center cavity is located in a rear center portion, said right shoulder blade extension is located in a rear right side, said right shoulder blade extension has a pointed shape, said center cavity being concave, said neck portion providing more coverage at a neck back side than a neck front side, said right side includes a right side proximal end adjacent said center portion that is configured to extend to a user's neck, said right side includes a right side distal end, said right side distal end is located in a right edge of a rear right side, said right side distal end is configured to extend down a user's arm below a right shoulder, said right side distal end and said left side distal end slope downwards, a right side cavity defined between said right side shoulder blade extension and said right side distal end, said right side cavity is located in said rear right side, said right side distal end includes a right side mounting member, said right side mounting member is located in said rear right side proximal to said right side distal end;

said attachment assembly includes two elastic straps that are mounted to said body cover assembly using said right side mounting member and said left side mounting member, said two elastic straps are configured to engage a user's right and left armpit, respectively, from a rear side of said body cover assembly to a front side of said body cover assembly, said two elastic straps are attached to a right side anchoring member and to a left side anchoring member, said right side anchoring member is located in a right edge of a right front side of said body cover assembly, said left side anchoring member is located in a left edge of a left front side of said body cover assembly, thereby said two elastic straps are configured to secure said sun protecting cover to a user's body, said body cover assembly is configured to shield a left shoulder of a user, a right shoulder of a user, a left shoulder blade of a user, a right shoulder blade of a user, a neck of a user, middle trapezius of a user and an upper portion of a back of a user from UV rays, said body cover assembly is configured to be entirely flush and in direct contact with a user's body, said left side is configured not to extend over a left acromion bone of a user, said right side is configured not to extend over a right acromion bone of a user, said sun protecting cover has an ultraviolet protection factor from 15 to 50 plus, said protecting cover is made of cloth.

10. A sun protecting cover system, consisting of:

a body cover assembly;

an attachment assembly mounted to said body cover assembly;

said body cover assembly having a left side, a center portion, a neck portion, and a right side;

said left side having a dimension that is configured to entirely cover a user's left middle trapezius, said right side having a dimension that is configured to entirely cover a user's right middle trapezius, said left side having a left side distal end configured to extend below a user's left shoulder, said left side distal end is located in a left edge of a rear left side, a left side proximal end adjacent said center portion configured to be extended to a user's neck, said neck portion is configured to substantially cover a user's neck and center middle trapezius, said neck portion extends upwards from said center portion, a front portion of said neck portion has a triangular shape, said right side being connected to said left side using said center portion, a left side cavity located in said rear left side being concave and defined between said left side distal end and a left side shoulder blade extension, said left side shoulder blade extension is located in said rear left side, said left side shoulder extension has a pointed shape, said left side distal end includes a left side mounting member, said mounting member is located in said rear left side proximal to said left side distal end, a center cavity extending from said left side shoulder blade extension to a right side shoulder blade extension, said center cavity is located in a rear center portion, said right shoulder blade extension is located in a rear right side, said right shoulder blade extension has a pointed shape, said center cavity being concave, said neck portion providing more coverage at a neck back side than a neck front side, said right side includes a right side proximal end adjacent said center portion that is configured to extend to a user's neck, said right side includes a right side distal end, said right side distal end is located in a right edge of a rear right side, said right side distal end is configured to extend down a user's arm below a right shoulder, said right side distal end and said left side distal end slope downwards, a right side cavity defined between said right side shoulder blade extension and said right side distal end, said right side cavity is located in said rear right side, said right side distal end includes a right side mounting member, said right side mounting member is located in said rear right side proximal to said right side distal end;

said attachment assembly includes two elastic straps that are mounted to said body cover assembly using said right side mounting member and said left side mounting member, said two elastic straps are configured to engage a user's right and left armpit, respectively, from a rear side of said body cover assembly to a front side of said body cover assembly, said two elastic straps are attached to a right side anchoring member and to a left side anchoring member, said right side anchoring member is located in a right edge of a right front side of said body cover assembly, said left side anchoring member is located in a left edge of a left front side of said body cover assembly, thereby said two elastic straps are configured to secure said sun protecting cover to a user's body, said body cover assembly is configured to shield a left shoulder of a user, a right shoulder of a user, a left shoulder blade of a user, a right shoulder blade of a user, a neck of a user, middle trapezius of a user and an upper portion of a back of a user from UV rays, said body cover assembly is configured to be entirely flush and in direct contact with a user's body, said left side is configured not to extend over a left acromion bone of a user, said right side is configured not to extend over a right acromion bone of a user, said sun protecting cover has an ultraviolet protection factor from 15 to 50 plus, said protecting cover is made of cloth, said left side shoulder blade extension and said right side shoulder blade extension define peaks which separate said left side cavity, said right side cavity and said center portion cavity.

* * * * *